US011371521B2

(12) United States Patent
Chandramohanan et al.

(10) Patent No.: US 11,371,521 B2
(45) Date of Patent: Jun. 28, 2022

(54) HIGH TEMPERATURE FACE SEAL

(71) Applicant: BorgWarner Inc., Auburn Hills, MI (US)

(72) Inventors: Rajmohan Chandramohanan, Fletcher, NC (US); Zachary Ashton, Arden, NC (US); Michael Jay Burkett, Lyman, SC (US)

(73) Assignee: BorgWarner Inc., Auburn Hills, MI (US)

( * ) Notice: Subject to any disclaimer, the term of this patent is extended or adjusted under 35 U.S.C. 154(b) by 52 days.

(21) Appl. No.: 16/380,726

(22) Filed: Apr. 10, 2019

(65) Prior Publication Data

US 2020/0325908 A1 Oct. 15, 2020

(51) Int. Cl.

| | |
|---|---|
| ***F04D 29/12*** | (2006.01) |
| ***F04D 29/056*** | (2006.01) |
| ***F04D 29/063*** | (2006.01) |
| ***F04D 17/10*** | (2006.01) |
| ***F04D 29/057*** | (2006.01) |
| ***F02B 37/00*** | (2006.01) |

(52) U.S. Cl.

CPC ..... *F04D 29/122* (2013.01); *F02B 37/00* (2013.01); *F04D 29/0563* (2013.01); *F04D 29/063* (2013.01); *F05D 2240/55* (2013.01)

(58) Field of Classification Search

CPC ..... F01D 25/18; F01D 25/24; F01D 25/162; F04D 29/122; F04D 29/0563; F04D 29/063; F05D 2240/55; F05D 2240/54; F05D 2240/14; F05D 2220/40; F05D 2260/602; F02C 6/12; F02C 7/28; F02C 7/06; F16C 33/1045; F16C 33/7886; F16C 2360/24; F16C 33/6685; F16C 33/1025; F16C 33/1065; F16C 30/1055; F16C 33/6659; F02B 33/40; F02B 37/00; Y10S 277/93

See application file for complete search history.

(56) References Cited

U.S. PATENT DOCUMENTS

| | | | |
|---|---|---|---|
| 2,432,684 | A | 12/1947 | Roshong |
| 2,824,759 | A | 2/1958 | Tracy |
| 3,026,114 | A | 3/1962 | Andresen et al. |
| 3,479,040 | A | 11/1969 | Tracy |
| 3,495,840 | A | 2/1970 | Wilk |
| 3,498,620 | A | 3/1970 | Wiese |
| 3,526,408 | A | 9/1970 | Tracy |
| 3,608,910 | A | 9/1971 | Tyler |
| 3,843,140 | A | 10/1974 | Mayer et al. |
| 3,921,986 | A | 11/1975 | Geary et al. |
| 4,103,907 | A | 8/1978 | Inouye et al. |
| 4,114,899 | A | 9/1978 | Kulzer et al. |
| 4,145,059 | A | 3/1979 | Imai et al. |

(Continued)

*Primary Examiner* — Eric J Zamora Alvarez

(74) *Attorney, Agent, or Firm* — von Briesen & Roper, s.c.

(57) ABSTRACT

A turbomachine face seal includes a turbine wheel with a cylindrical shaft extending from the turbine wheel, defining an axis of rotation. The shaft may include a heat throttle, such as a piston ring and groove assembly, or a shaft weld pocket having an annular heat choke groove. Circumscribing the shaft is a casing and a seal ring having a groove with a seal element. To cool the seal element, a pressurized oil jet is directed toward the casing, and impinges against the casing. The oil jet may be angled or parallel with the axis of rotation. The casing may be configured to trap oil from the oil jet to cool the seal element.

18 Claims, 7 Drawing Sheets

(56) References Cited

U.S. PATENT DOCUMENTS

| | | | | |
|---|---|---|---|---|
| 4,586,717 | A | 5/1986 | Sweeney | |
| 4,749,199 | A | 6/1988 | Gresh | |
| 5,301,957 | A | 4/1994 | Hwang et al. | |
| 5,468,002 | A | 11/1995 | Wasser | |
| 5,909,878 | A | 6/1999 | Schrufer et al. | |
| 5,938,205 | A | 8/1999 | Azibert, V et al. | |
| 6,325,380 | B1 | 12/2001 | Feigl et al. | |
| 6,761,359 | B2 | 7/2004 | Azibert, V | |
| 6,943,468 | B2 | 9/2005 | Iida et al. | |
| 7,946,118 | B2 | 5/2011 | Hippen et al. | |
| 8,833,053 | B2 | 9/2014 | Chir et al. | |
| 9,169,738 | B2 * | 10/2015 | Schlienger | F01D 25/125 |
| 9,328,692 | B2 | 5/2016 | Rado et al. | |
| 9,447,753 | B2 | 9/2016 | Kuribayashi et al. | |
| 9,695,708 | B2 | 7/2017 | Hettinger et al. | |
| 10,036,346 | B2 | 7/2018 | Maki et al. | |
| 10,087,780 | B2 | 10/2018 | Poomkuzhimannil et al. | |
| 2017/0248032 | A1 * | 8/2017 | Williams | F01D 25/162 |
| 2018/0135698 | A1 * | 5/2018 | Toyota | F16C 33/76 |
| 2018/0283269 | A1 * | 10/2018 | Wu | F01M 11/04 |

* cited by examiner

HIGH TEMPERATURE FACE SEAL

TECHNICAL FIELD

The present disclosure relates generally to turbomachines and, more particularly, to a face seal of a turbomachine that is able to withstand high-temperature applications.

BACKGROUND

Turbomachines are used in various applications, including automotive, aerospace, marine and even for renewable energy production. A turbomachine, such as a turbocharger, is used to increase the intake pressure of an engine, thereby improving an engine's power and efficiency, and typically includes a hot side, i.e. a turbine wheel, and a cooler side, i.e. a compressor, connected by a bearing section that houses a shaft. Entry of contaminants like oil and unwanted gas (i.e. blowby) into the shaft and/or bearing housing can result in unwanted emissions and inhibited performance. As such, various types of seals are used at both the turbine side and compressor side of the turbomachine to prevent or limit gas blowby and oil leakage.

While functional, conventional seals wear rapidly in high temperature environments. Seals often must be made from flexible materials like elastomers, in order to properly perform a sealing function. Elastomers, however, begin to degrade at temperatures lower than occur at the turbine side of a turbomachine. Examples of elastomers include fluorocarbons and silicones, which are limited to about 200° C., and perfluoroelastomers, which are limited to about 320° C. Typical high temperature turbomachine environments include spark ignition engines, and, increasingly, turbocharged gasoline engines, among others. In some turbocharged gasoline engine systems, exhaust temperatures can reach 1050° C. or higher.

Prior art attempts to reduce temperatures within seal assemblies, such as those between rotatable members and fixed members, have merely aimed to reduce heat generated by friction. In this regard, a lubricant, such as oil, is used to lower pressure between adjacent rubbing surfaces, which reduces friction, thereby minimizing heat generated during rotation. Lubricating adjacent surfaces to reduce friction is disadvantageous for cooling assemblies, however, when high operating temperatures originate outside the assembly. An example of a prior art seal assembly in this regard is U.S. Pat. No. 3,608,910.

There is consequently a need for a face seal that limits heat transfer within a turbomachine that can be used in higher operating temperatures, while reducing turbocharger turbine end blowby and oil leakage.

SUMMARY

In accordance with one aspect of the present disclosure, a turbocharger face seal for use in high temperature applications is disclosed. The turbocharger face seal includes a turbine wheel, with a cylindrical shaft extending from the turbine wheel and defining an axis of rotation. The shaft extends from the turbine wheel toward a compressor wheel connected to an opposite end of the shaft. Proximate the turbine wheel, the shaft also includes an annular shoulder extending radially outward from the axis of rotation. The turbocharger face seal also includes a bearing housing with a bore dimensioned to receive the shaft.

Circumscribing the shaft at the end proximate the turbine wheel is a casing. The casing has an annular shoulder extending radially outward that engages an outer edge of the bearing housing. Opposite the shoulder is an arm that extends radially inward toward the shaft. Positioned radially between the casing and the shaft is a seal ring. An oil gallery extends through the bearing housing, and is adapted to have a supply of oil. A pressurized oil jet extends from the oil gallery, through an oil jet orifice and toward the casing. The oil jet impinges a surface of the casing.

In another embodiment, a turbocharger face seal includes a turbine wheel at one end, with a cylindrical shaft extending from the turbine wheel and defining an axis of rotation. The shaft extends from the turbine wheel toward a compressor wheel connected to an opposite end of the shaft. Proximate the turbine wheel, the shaft also includes an annular shoulder extending radially outward from the axis of rotation. The turbocharger face seal includes a bearing housing with an oil cavity and a bore dimensioned to receive the shaft.

Circumscribing the shaft at the end proximate the turbine wheel is a casing. The casing has an annular shoulder extending radially outward that engages an outer edge of the bearing housing. Opposite the shoulder is an arm that extends radially inward toward the shaft. Positioned radially between the casing and the shaft is a seal ring. An oil gallery, which extends through the bearing housing, is fluidly connected to the oil cavity and is adapted to have a supply of oil. A pressurized oil jet extends from the oil cavity, through an axial oil jet orifice and toward the casing. The oil jet impinges a surface of the casing.

A second pressurized oil jet may also be utilized with the aforementioned structure. In this embodiment, the bearing housing also includes a journal bearing. To restrict axial movement of the journal bearing, a spacer is fixed to an outer circumference of the shaft. The spacer includes an inner surface fixed to the shaft and an opposite outer surface. The spacer is positioned radially between the shaft and each of the seal ring, the casing, and a portion of the journal bearing. A rib protrudes radially outward from the outer surface of the spacer. The oil cavity in this embodiment includes a second oil jet orifice that extends from the oil cavity through the journal bearing. The second pressurized oil jet, therefore, extends from the oil cavity, through the second oil jet orifice and toward the spacer rib. The second oil jet impinges a surface of the spacer rib.

In a further embodiment, a turbocharger face seal includes a turbine wheel at one end, with a cylindrical shaft extending from the turbine wheel and defining an axis of rotation. The shaft extends from the turbine wheel toward a compressor wheel connected to an opposite end of the shaft. Proximate the turbine wheel, the shaft also includes an annular shoulder extending radially outward from the axis of rotation. A spacer is fixed to an outer surface of the shaft to restrict axial movement of a journal bearing. Circumscribing the shaft at the end proximate the turbine wheel is a casing. The casing has an annular shoulder extending radially outward that engages an outer surface of a bearing housing.

Positioned radially between the casing and the spacer is a seal ring. Affixed to the seal ring is a first end of a bellows. The bellows is dimensioned to surround the shaft and the spacer and includes a second end opposite the first end attached to the seal ring. The second end includes a flange that is affixed to the casing.

In yet another embodiment, a turbocharger face seal for use in high temperature applications is disclosed. The turbocharger face seal includes a turbine wheel at one end, with a cylindrical shaft extending from the turbine wheel and defining an axis of rotation. The shaft extends from the turbine wheel toward a compressor wheel connected to an opposite end of the shaft. Proximate the turbine wheel, the shaft also includes an annular shoulder extending radially outward from the axis of rotation. The turbocharger face seal includes a bearing housing with a bore dimensioned to receive the shaft and a journal bearing with an axial oil jet orifice that is fluidly connected to an oil cavity.

Circumscribing the shaft is a casing. The casing has an annular shoulder extending radially outward that engages an outer edge of the bearing housing. Opposite the annular shoulder, the casing includes an arm that extends radially inward toward the shaft. A curved section of the casing arm defines a heat transfer surface. A balanced pressure seal ring is positioned adjacent the shoulder of the shaft, and radially between the casing and the shaft. A pressurized oil jet extends from the oil cavity, through the axial oil jet orifice and toward the heat transfer surface. The pressurized oil jet impinges the heat transfer surface.

These and other aspects and features of the present disclosure will be more readily understood when read in conjunction with the accompanying drawings.

DETAILED DESCRIPTION

Figure 1:
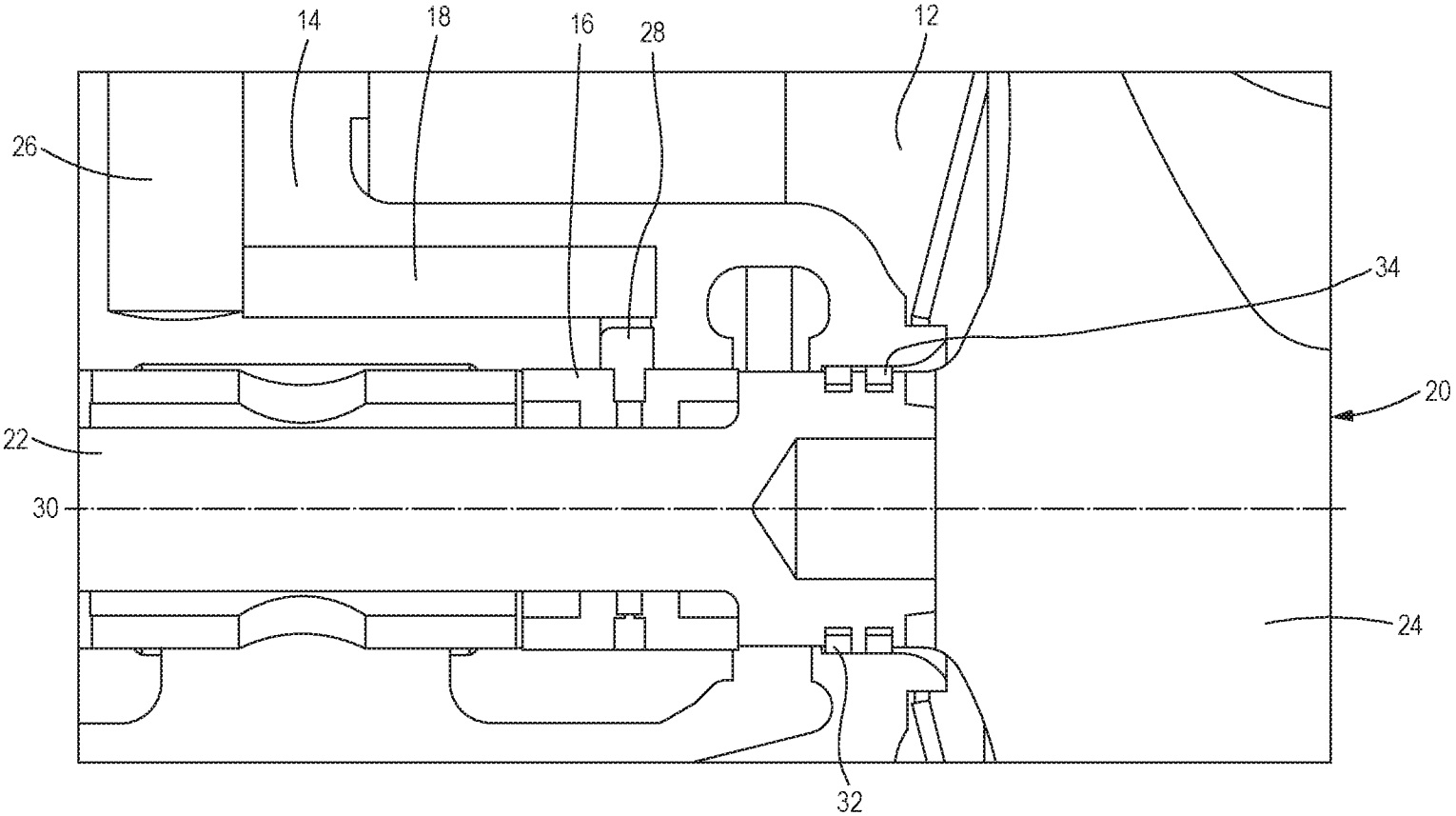
FIG. 1 is a cross-sectional view of a turbine side of a turbomachine employing an embodiment of a seal using multiple piston rings.

Referring now to the drawings, and with specific reference to FIG. 1, existing technology for sealing a turbine side of turbomachinery (e.g. an exhaust gas turbocharger) is shown. The turbomachine is shown surrounded by a heat shield 12, with a shaft and wheel assembly, indicated generally at 20, comprised of a shaft 22 and a turbine wheel 24. A bearing housing 14 circumscribes the shaft 22 and houses a journal bearing 16, which is supplied with oil from an oil gallery 18 via an oil inlet 26. The oil gallery 18 is fluidly connected to an oil supply cavity 28 in the bearing housing 14. The shaft 22 includes one or more grooves 32 dimensioned to accommodate at least one piston ring 34. Each piston ring 34 is dimensioned to fit within the corresponding groove 32 of the shaft 22. The piston rings 34 act as labyrinth seals, creating a torturous flow path for hot air, thereby decreasing blowby flow from the turbine 24.

Increasing a number of piston rings decreases the blowby flow; however, as the number of piston rings increases, so does the cost of manufacture as well as the axial length of the turbomachine. In applications such as combustion engine turbochargers, especially motor vehicle turbochargers, availability of underhood space is a premium and keeping cost of manufacture as low as possible is essential, making this approach disadvantageous. Similarly, piston rings can wear down, especially in high temperature environments, limiting the life of a turbomachine. Piston rings are also susceptible to coking of oil in their respective grooves. Coking immobilizes the piston rings, thereby increasing blowby from the turbine.

Face seals, which can be used either in a contacting configuration or a non-contacting configuration, have been successful in reducing blowby at a compressor (cool) side of a turbomachine. Typical compressor side temperatures in a turbocharger, for example, often range between 150° C. to 200° C. As such, compressor side face seals commonly use an O-ring to seal gas pressure (shown in FIG. 2).

Figure 2:
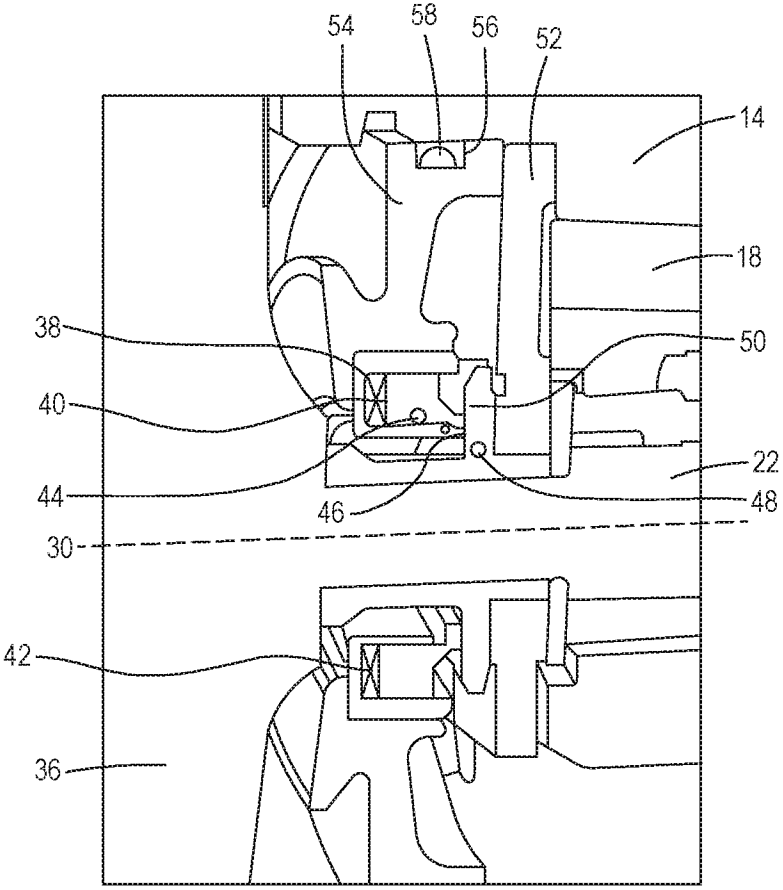
FIG. 2 is a cross-sectional view of a compressor side of a turbomachine employing an embodiment of a face seal.

Regarding FIG. 2, a cartridge-type face seal for sealing a compressor side of turbomachinery (e.g. an exhaust gas turbocharger) is shown. The face seal prevents high pressure blowby air generated by a compressor wheel 36 from entering an interior of the turbomachine, which reduces compressor mass flow and efficiency.

The face seal assembly includes a case 38 that circumscribes a shaft 22, a seal ring 40, a biasing element 42, and a seal element 44. The shaft 22 defines an axis of rotation 30. While the seal ring 40 may slide axially in the case 38, the seal ring and case are provided with suitable anti-rotation features (not shown) to prevent axial rotation of the seal ring within the case. The seal ring 40 may be made from a carbon material, and surrounds the seal element 44, which may be an O-ring. The seal element 44 may prevent gases from bypassing the face seal and entering the interior of the turbomachine.

The seal ring 40 has an axially interior surface 46 manufactured to be very flat or smooth. The biasing element 42 urges the seal ring 40 towards a flinger 48, thereby urging the interior surface 46 of the seal ring against an axially exterior surface 50 of the flinger and creating a seal. The flinger 48 is clamped between the compressor wheel 36 and a thrust bearing 52, and so rotates as the shaft 22 rotates. The exterior surface 50 of flinger 48 may contain spiral grooves for generating fluid pressure when the shaft 22 is rotating. The pressure generated by the fluid pushes against the biasing spring 11 and creates a gap (not shown) between the surface 46 of the seal ring 40 and the surface 50 of the flinger 48. The fluid pressure generated in the gap creates a barrier to compressor blowby gas leakage.

The face seal assembly may be pre-assembled and then installed in an insert 54. The case 38 may be mounted in the insert 54 by any means known in the art, including an interference fit, so as to prevent leakage and to fix the position of the case within the insert. The insert 54 is then mounted in the bearing housing 14, and is provided with a groove 56 for a seal 58, which may be an O-ring type seal. While both the compressor side and the turbine side of a turbomachine could benefit from the long life and reliability of a face seal, the turbine side sustains much higher temperatures, due to the presence of combustion gas acting on the turbine wheel. For example, in a commercial vehicle turbocharger, temperatures in the turbine end may exceed 300° C. during operation and 400° C. during "soak back," that is, when the engine is stopped and the heat stored in the turbine transfers through the turbocharger. As such, there is a need for means to cool various elements of the face seal to allow it to function reliably when installed at the turbine side of a turbomachine.

Figure 3:
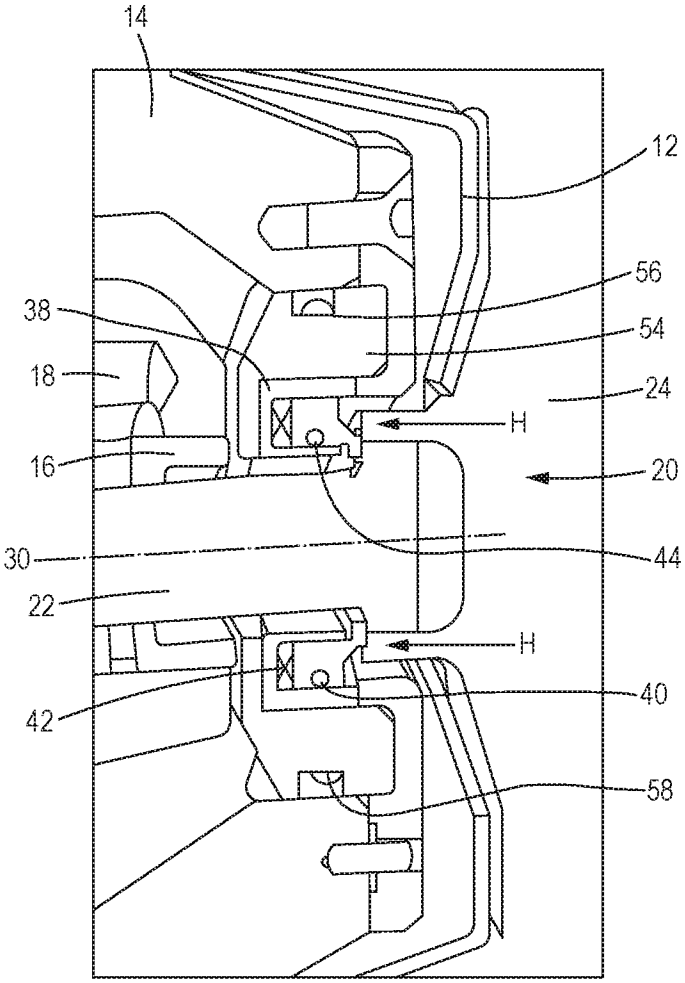
FIG. 3 is a cross-sectional view of a turbine side of a turbomachine employing an embodiment of a face seal.

Referring now to FIG. 3, an embodiment of a face seal in the high-temperature environment of the turbine side of a turbomachine is shown. Components that are shared with the seals in FIGS. 1 and 2 are designated with identical reference numbers.

In this embodiment, the shaft 22 includes a radial flange 62 at the turbine side of the turbomachine. Together, an axially exterior surface 60 of the seal ring 40 and an axially interior surface 64 of the shaft flange 62, create a seal pair. Direct heat paths, designated "H," indicate the origin and direction of high temperature exhaust gas during use of the turbomachine. The exhaust gas originates from the turbine wheel 24 and is directly absorbed by the shaft 22. Because the turbine wheel 24 and the shaft 22 may be comprised of metal alloys made to withstand the temperatures and stresses associated with the turbine side of a turbomachine, the turbine wheel and shaft both have high thermal conductivities. As such, heat transfers quickly from the high temperature exhaust gas, through the turbine wheel 24 and the shaft 22, and is directly applied to, and passes through, the seal ring 40.

The seal ring 40 may be comprised of a variety of materials, including, but not limited to, carbon, silicon nitride, silicone nitride, or other ceramics. Other seal elements in the face seal, however, such as the insert seal 58 and the seal element 44, typically must be made from flexible elastomers to achieve a proper seal. Elastomers, however, begin to degrade at lower temperatures than occur at the turbine side of a turbomachine. Fluorocarbons ("FKM") and silicones, for example, are limited to about 200° C., and perfluoroelastomers are limited to about 320° C. Accordingly, while a face seal may extend the life of a turbomachine by reducing the blowby flow from a turbine wheel, as well as being less susceptible to coking and other issues that plague piston ring seals (see FIG. 1), a face seal still often requires use of seal elements that can degrade quickly in the high temperature environment. Without a method of cooling the seal elements, they may degrade quickly, and fail to seal properly.

While other types of metal seals such as "C" rings are available, the high friction of these seals within the face seal assembly can, for example, restrict axial motion of the seal ring 40. Further, the cost of metal seals is much higher than that of flexible elastomer seals, such as O-rings. Due to the low cost and ease of assembly of flexible elastomer seals, it would be advantageous if a face seal could use them under high temperature conditions. In addition to the high temperatures of exhaust gas, exhaust blowby gases carry corrosive chemicals as by-products of combustion, which can also degrade engine oil. It would therefore be advantageous to use a face seal on the turbine end of a turbomachine, but features are needed to cool the seal elements, reduce the turbine air flow directed at the seal elements, and throttle heat flux originating from the turbine wheel.

Referring to FIGS. 4-8, exemplary embodiments of a face seal, indicated generally at 10, for reducing turbomachine turbine end blowby and oil leakage with improved temperature capability are shown. Components that are shared with the seals in FIGS. 1-3 are designated with identical reference numbers.

Figure 4:
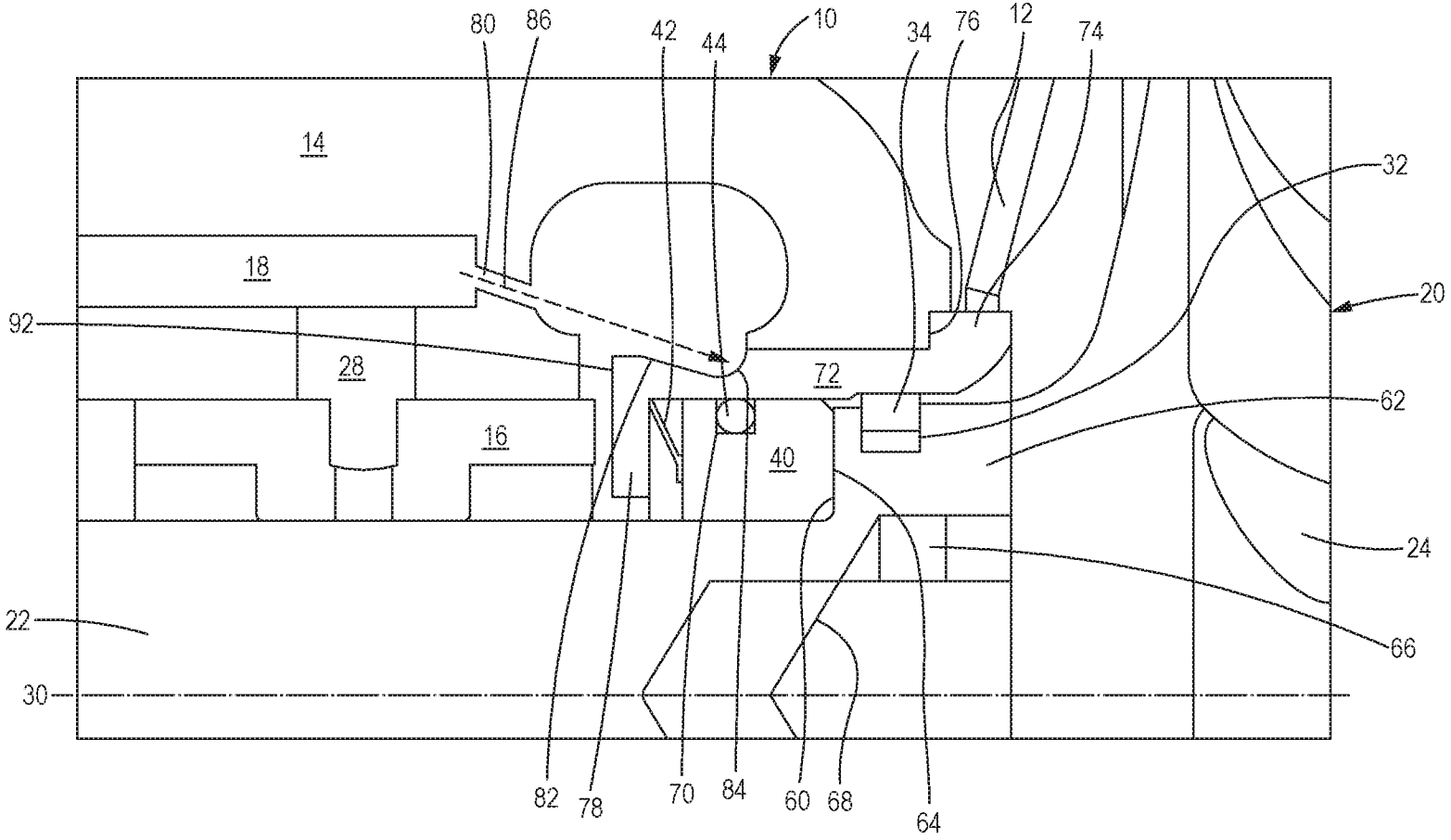
FIG. 4 is a cross-sectional view of a face seal of a turbomachine, employing an oil jet construction in accordance with an embodiment of the present disclosure.

FIG. 4 is a cross-sectional view of a face seal 10 installed at a turbine side of a turbomachine, and employing an oil jet cooling construction in accordance with a first embodiment of the present disclosure. In particular, FIG. 4 depicts a shaft and wheel assembly 20 that includes a cylindrical shaft 22 that extends from a turbine wheel 24 toward a compressor wheel 36, defining an axis of rotation 30. The shaft and wheel assembly 20 may contain an undercut or groove 66, which, together with one or more piston ring grooves 32, acts as a heat choke to reduce heat flow into the face seal assembly 10, thereby reducing heat flow toward a seal ring 40. Reducing heat flow toward the face seal 10 may consequently reduce temperatures of metallic and elastomer elements within the face seal (e.g. the shaft 22 and the seal element 44), that may be adjacent to, or in contact with, the seal ring 40. Further, or alternatively, this feature may take the form of a more optimized shaft weld pocket, depicted as outline 68, that reduces the material cross sectional area beneath the piston ring groove 32 dimensioned to accommodate a piston ring 34. The piston ring 34 reduces entry of hot gas into the shaft 22 from the turbine wheel 24 in the direction of heat flow, indicated as "H." While FIG. 4 is shown with a single piston ring groove 32 and piston ring 34, other arrangements may include more than one piston ring, or no piston rings. If, for example, the piston ring 34 is not used, the corresponding groove 32 in the shaft 22 may still be employed to act as a heat choke to reduce heat flow to the seal ring 40, thereby increasing the durability of the face seal 10.

A radially outwardly directed flange 62 extends from an end of the shaft 22 proximate the turbine wheel 24, and restricts axial movement of the seal ring 40 within the face seal 10. More specifically, an axially interior surface 64 of the flange 62 contacts an axially exterior surface 60 of the seal ring 40, forming a seal pair. The interior surface 64 of the flange 62 may contain spiral grooves, as in known in the art for generating fluid pressure when the shaft 22 is rotating. The seal ring 40 may be comprised of a variety of materials, including, but not limited to, carbon, silicon nitride, silicone nitride, or other ceramics. The seal ring 40 may also include a groove or channel 70 dimensioned to house a seal element 44, which may be comprised of a flexible elastomer.

The face seal 10 also includes a casing 72, which is installed in a bore of the bearing housing 14. The casing 72 may be press fit into the bore, but other means of installation, such as by a threaded connection or use of a retaining ring, may be used. While not shown in the figures, the casing 72 may also be defined as a region of the bearing housing 14, rather than a discrete element of the face seal 10. This arrangement is advantageous because extending the body of the bearing housing 14 to include the structure of the casing 72 eliminates the need for a seal at the seam between the casing and bore of the bearing housing. Similarly, eliminating the seam also eliminates an entrance for hot air from the turbine wheel 24, thereby reducing temperatures within the face seal 10.

The casing 72 includes a radially outwardly extending retaining flange 74 proximate the turbine wheel 24, which engages an outer edge 76 of the bearing housing 14. The engagement of the retaining flange 74 of the casing 72 with the outer edge 76 of the bearing housing 14 both restricts axial movement of the casing within the bearing housing, and creates a seal that prevents entry of gas and contaminants into the bearing housing.

Opposite the retaining flange 74, the casing 72 includes a radially inwardly extending oil flange 78, which both provides a barrier to restrict axial movement of a journal bearing 16 within the bearing housing 14, but also provides an axially inner seat for a biasing element 42 that surrounds the shaft 22. The biasing element 42 may be a coiled spring, but other types of springs are contemplated as well. The biasing element 42 is positioned between the seal ring 40 and the oil flange 78, urging the seal ring axially outward and forcing engagement of the exterior surface 60 of the seal ring against the interior surface 64 of the shaft 22. In an opposite direction, the biasing element 42 urges the casing 72 in an axially inward direction and away from the turbine wheel 24, thereby forcing engagement of retaining flange 74 with the external surface 76 of the bearing housing 14. The stiffness or type of biasing element 42 employed in this embodiment may determine the axial distance the seal ring 40 and casing 72 are able to travel within the face seal 10. For example, if the biasing element 42 is a linear coil compression spring, the axial travel distance of the seal ring 40 and casing 72 may decrease as the spring stiffness increases.

In this embodiment, a jet of oil 80 may be used to strike the casing 72 at a surface area 82, 84 proximate the seal element 44. More specifically, the bearing housing 14 includes an oil gallery 18, which may be fluidly connected to an oil supply cavity 28 and an oil jet orifice 86. The oil gallery 18 maintains a supply of oil. The oil, under pressure, is fed through the oil jet orifice 86, which produces the oil jet 80 and directs the oil jet toward a concave curved surface 84 of the casing 72. A portion of the casing 72 includes a surface 82 that provides a clearance path for the oil jet 80, which helps direct the oil toward the curved surface 84. The curved or concave surface 84 of the casing 72 may be located proximate the seal element 44, such that as the oil jet 80 impinges and cools the curved surface 84, heat may be drawn away from the seal element, thereby cooling the seal element. While one oil jet orifice 86 is shown in this particular embodiment, multiple oil jet orifices may be used to enhance cooling (see FIG. 6).

Figure 5:
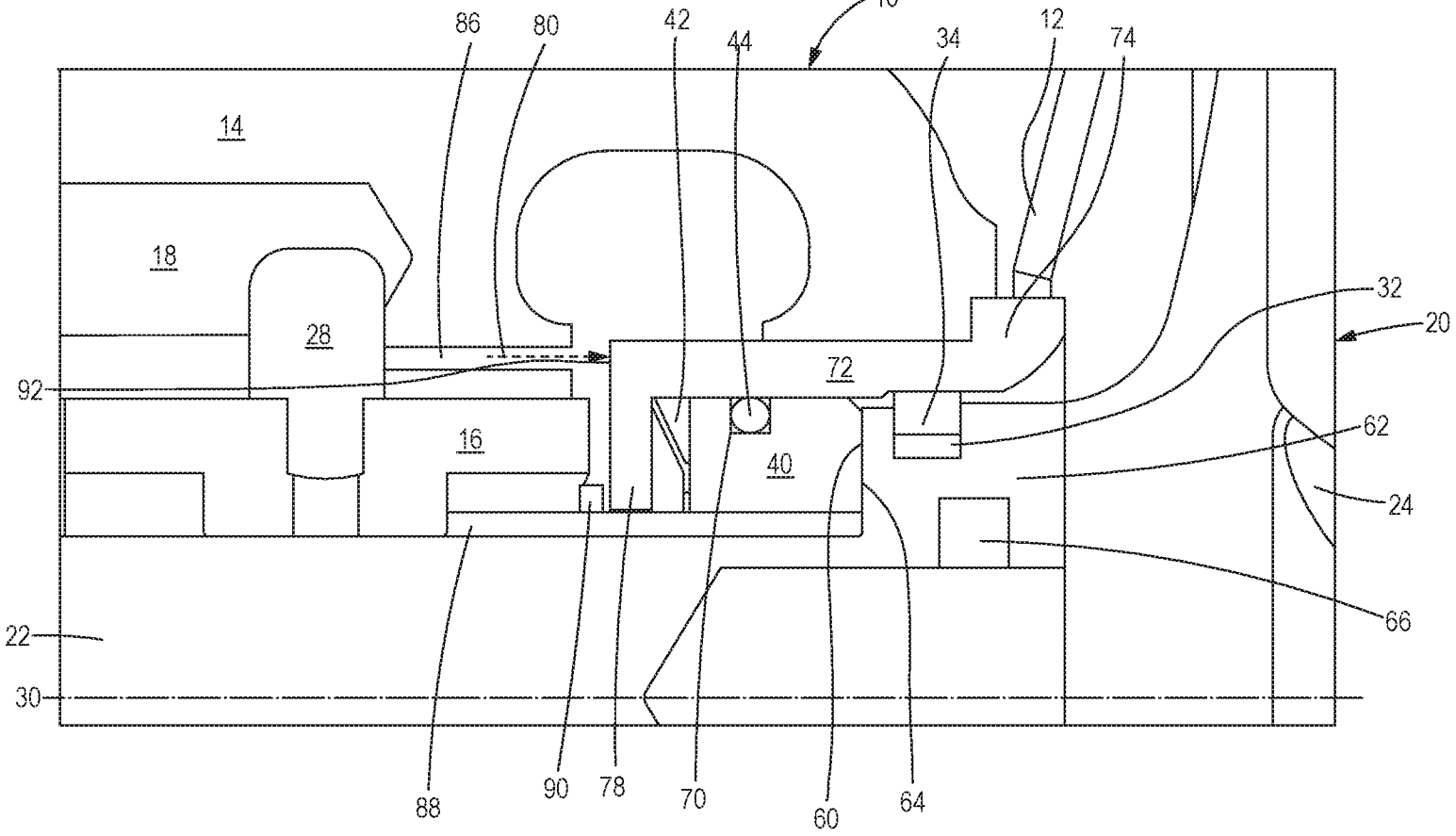
FIG. 5 is a cross-sectional view of a face seal of a turbomachine, employing an axial oil jet construction in accordance with an embodiment of the present disclosure.

In another embodiment, shown in FIG. 5, the oil jet 80 is oriented axially, and the surface of the casing 72 is altered to accommodate the impinging oil jet. As in the previous embodiment, the face seal 10 includes the casing 72, which is installed in the bore of the bearing housing 14. Likewise, the radially outwardly extending retaining flange 74 engages the external surface 76 of the bearing housing 14, both restricting axial movement of the casing 72 within the bearing housing, and creating the seal that prevents entry of gas and contaminants into the bearing housing. Opposite the flange retaining flange 74, the casing 72 includes the radially inwardly extending oil flange 78, which provides the axially inner seat for the biasing element 42. The biasing element 42 is positioned between the seal ring 40 and the oil flange 78, urging the seal ring axially outward and forcing engagement of the external surface 60 of the seal ring and the interior surface 64 of the shaft flange 62. In the opposite direction, the biasing element 42 also urges the casing 72 axially inward and away from the turbine wheel 24, thereby forcing the engagement of retaining flange 74 with the external surface 76 of the bearing housing 14.

In this embodiment, the face seal 10 also includes a spacer 88 fixed to the radially outside surface of the shaft 22, to reduce heat conduction through the shaft. The spacer 88 may be positioned between the shaft 22 and the seal ring 40, biasing element 42, casing 72 and a portion of the journal bearing 16, and may be made of a metal with low thermal conductivity, to reduce heat transfer from the shaft to the seal ring, biasing element, casing and journal bearing. The spacer 88 may be fixed to the shaft 22 by an interference fit, to enable rotation with shaft; however, other methods of fixing the spacer to the shaft may be utilized, including, but not limited to, crimping or welding. The spacer 88 further includes a radially extending rib 90, which augments heat transfer away from the seal element 44.

As in the previous embodiment, the oil gallery 18 may be fluidly connected to the oil supply cavity 28, which feeds the journal bearing 16. The oil jet orifice 86 may be fluidly connected to the oil supply cavity 28, and oriented parallel to the axis of rotation 30. The oil, under pressure, is fed from the oil supply cavity 28 through the axially-oriented oil jet orifice 86, producing the oil jet 20. To cool the seal element 44 installed in the seal ring 40, the oil jet 20 is directed toward an axially interior surface 92 of the oil flange 78. The surface 92 of the oil flange 78 is oriented perpendicular to both the axis of rotation 30 and the oil jet 20. Accordingly, as the oil impinges the surface 92 of the casing 72, the oil may drain radially inward toward the spacer 88. Oil that contacts the spacer rib 90, however, may be flung off due to rotation of the shaft and wheel assembly 20.

As the seal element 44 cools, heat may be transferred away from the seal element toward the oil jet orifice 86 and interior surface 92 of the oil flange 78, thereby forming a heat transfer path. The oil flow required to cool the seal element 44 may be directly proportional to the length of the heat transfer path. In other words, as the length of the heat transfer path increases, more oil flow may be required. To further augment heat transfer away from the seal element 44, the surface 92 of the oil flange 78, as well as a radially exterior surface 94 of the casing 72, may be provided with one or more grooves (not shown) for capturing oil.

Figure 6:
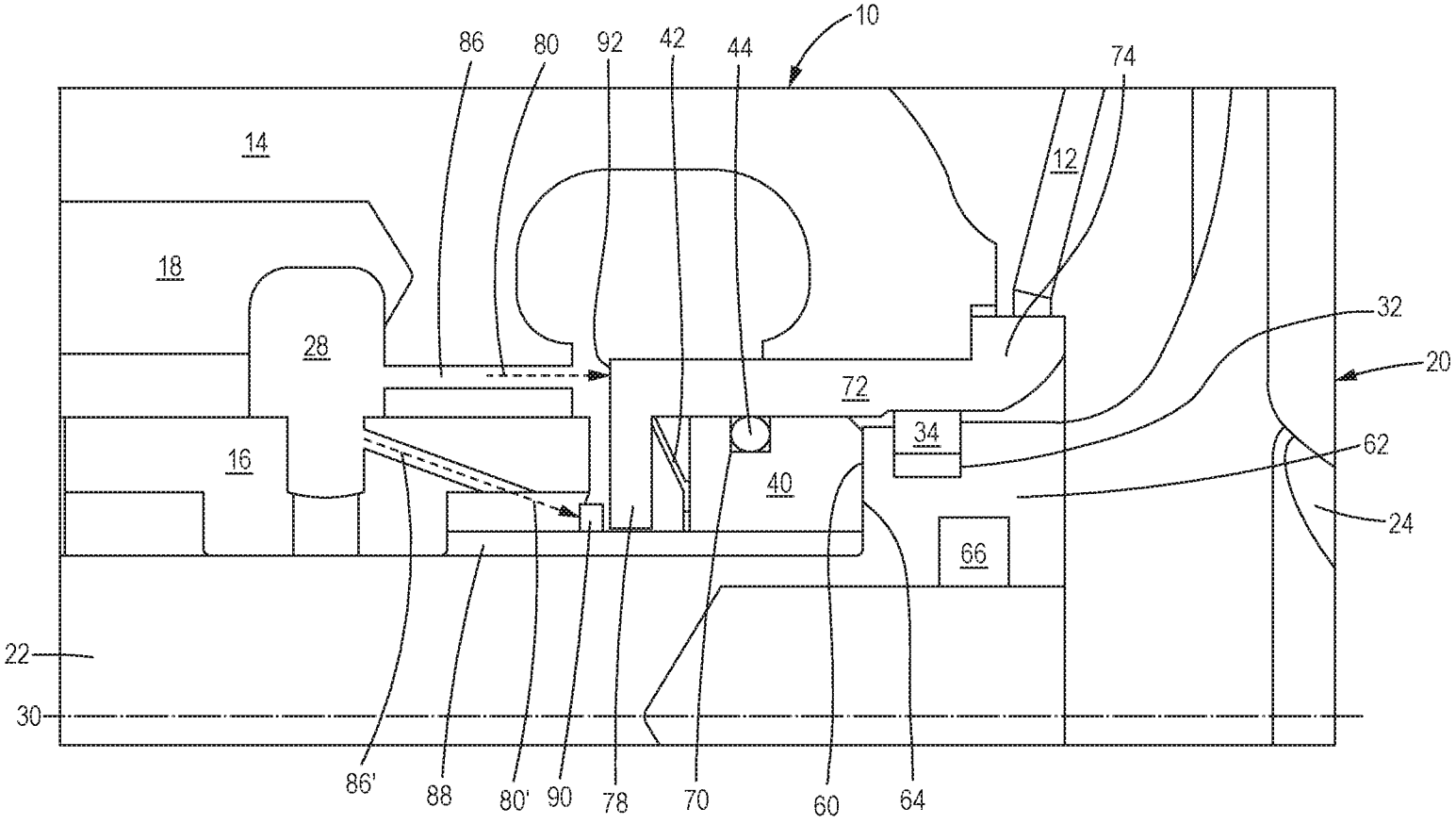
FIG. 6 is a cross-sectional view of a face seal of a turbomachine, employing an oil jet in a journal bearing construction in accordance with an embodiment of the present disclosure.

To enhance cooling of the seal element 44, a second oil jet orifice 86' may be added to journal bearing 16, for increased cooling on the spacer 88, as shown in FIG. 6. In this embodiment, oil jet orifice 86 may or may not be used, as needed. The oil, under pressure, is fed from the oil supply cavity 28 through the second oil jet orifice 86', producing a second oil jet 80'. The second oil jet 80' impinges the spacer rib 90 to cool the spacer 88, which contacts the seal ring 40, thereby further cooling the seal element 44. As discussed in reference to the previous embodiment, excess oil from the second oil jet 80' that impinges the spacer rib 90 may be flung off due to rotation of the shaft and wheel assembly 20.

Figure 7:
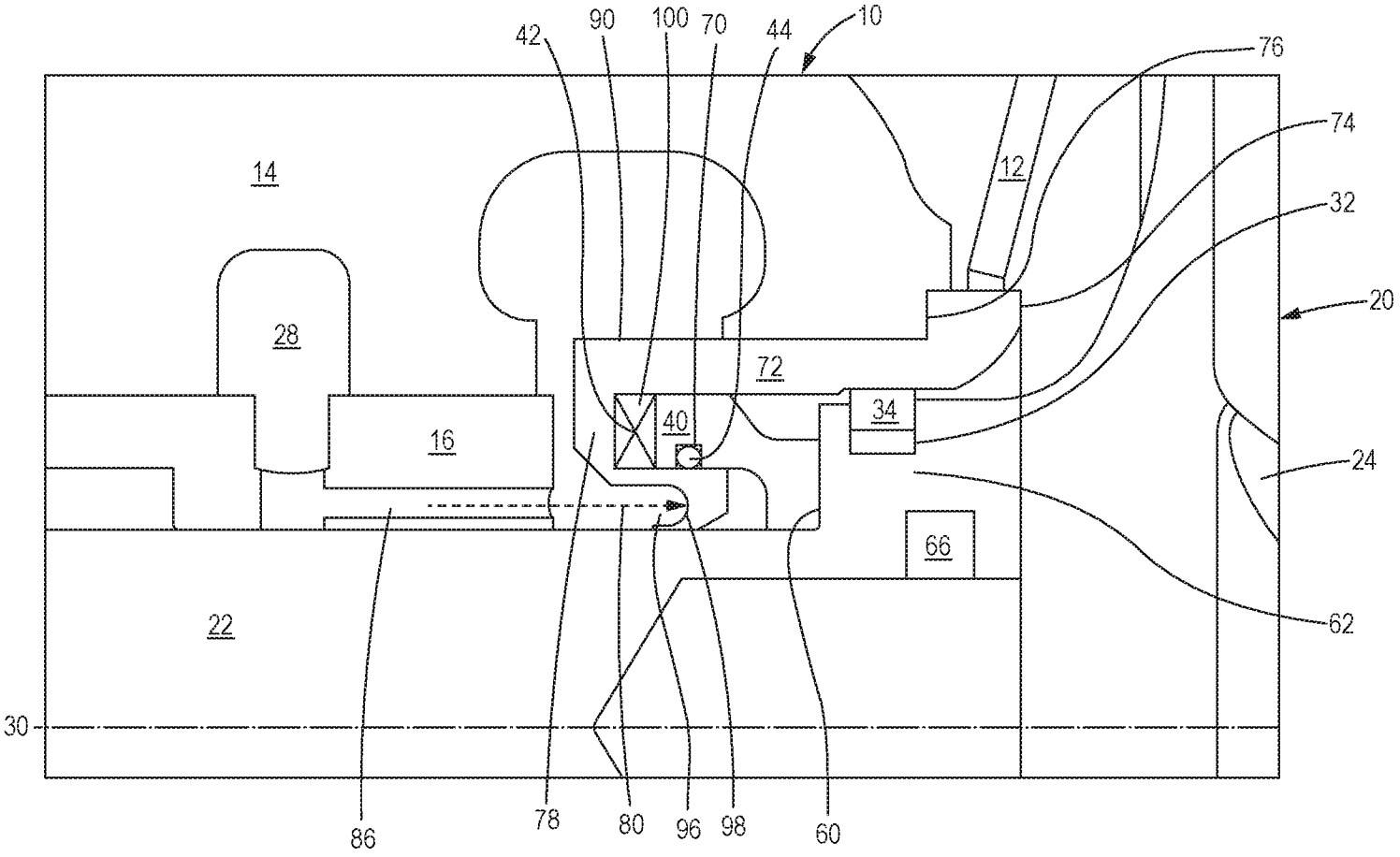
FIG. 7 is a cross-sectional view of a face seal of a turbomachine, employing a balanced pressure O-ring construction in accordance with an embodiment of the present disclosure.

In yet another embodiment of the present invention, shown in FIG. 7, the oil jet orifice 86 and oil jet 80 are both oriented axially, extending through the journal bearing 16, and an alternate balanced pressure seal ring 40 is employed.

As in the previous embodiments shown in FIGS. 4-6, the face seal 10 includes the casing 72, which is installed in the bore of the bearing housing 14. Similarly, the radially outwardly extending retaining flange 74 engages the external surface 76 of the bearing housing 14, both restricting axial movement of the casing 72 within the bearing housing, and creating a seal that prevents entry of gas and contaminants into the bearing housing. Opposite the retaining flange 74, the casing 72 includes the second radially inwardly extending oil flange 78, which provides the axially inner seat for the biasing element 42. In this embodiment, at an end of the oil flange 78 proximate the shaft 22, a concave recess 96 extends axially toward the turbine side of the turbomachine. The concave recess 96 defines a heat transfer surface 98, which may be provided with one or more grooves (not shown) to augment heat transfer. Together, the casing 72, oil flange 78 and recess 96 form a channel 100 dimensioned to house the biasing element 42 and a portion of the seal ring 40. The portion of the seal ring 40 fitted in the channel 100 includes the groove 70 dimensioned to accommodate the seal element 44. This arrangement causes the seal element 44 to be located proximate the heat transfer surface 98 of the recess 96, to further augment heat transfer.

The biasing element 42, such as a coiled spring, is positioned between the seal ring 40 and the oil flange 78, and urges the seal ring axially outward against the interior surface 64 of the shaft flange 62. In the opposite direction, the biasing element 42 urges the casing 72 axially inward and away from the turbine wheel 24, thereby forcing the engagement of retaining flange 74 with the exterior surface 76 of the bearing housing 14.

As in the previous embodiments shown in FIGS. 4-6, the oil supply cavity 28 feeds the journal bearing 16, and is adapted to have the supply of oil. The oil jet orifice 86, extends through the body of the journal bearing 16, and is oriented parallel to the axis of rotation 30. The oil, under pressure, is fed initially to the journal bearing 16 from the oil supply cavity 28. The oil then passes through the axially-oriented oil jet orifice 86, producing the oil jet 80. To cool the seal element 44 installed in the seal ring 40, the oil jet 80 is directed toward the recess 96 and impinges the heat transfer surface 98. As the oil impinges the heat transfer surface 98 of the casing 72, the oil may collect in the recess 96, thereby augmenting heat transfer away from the seal element 44.

Figure 8:
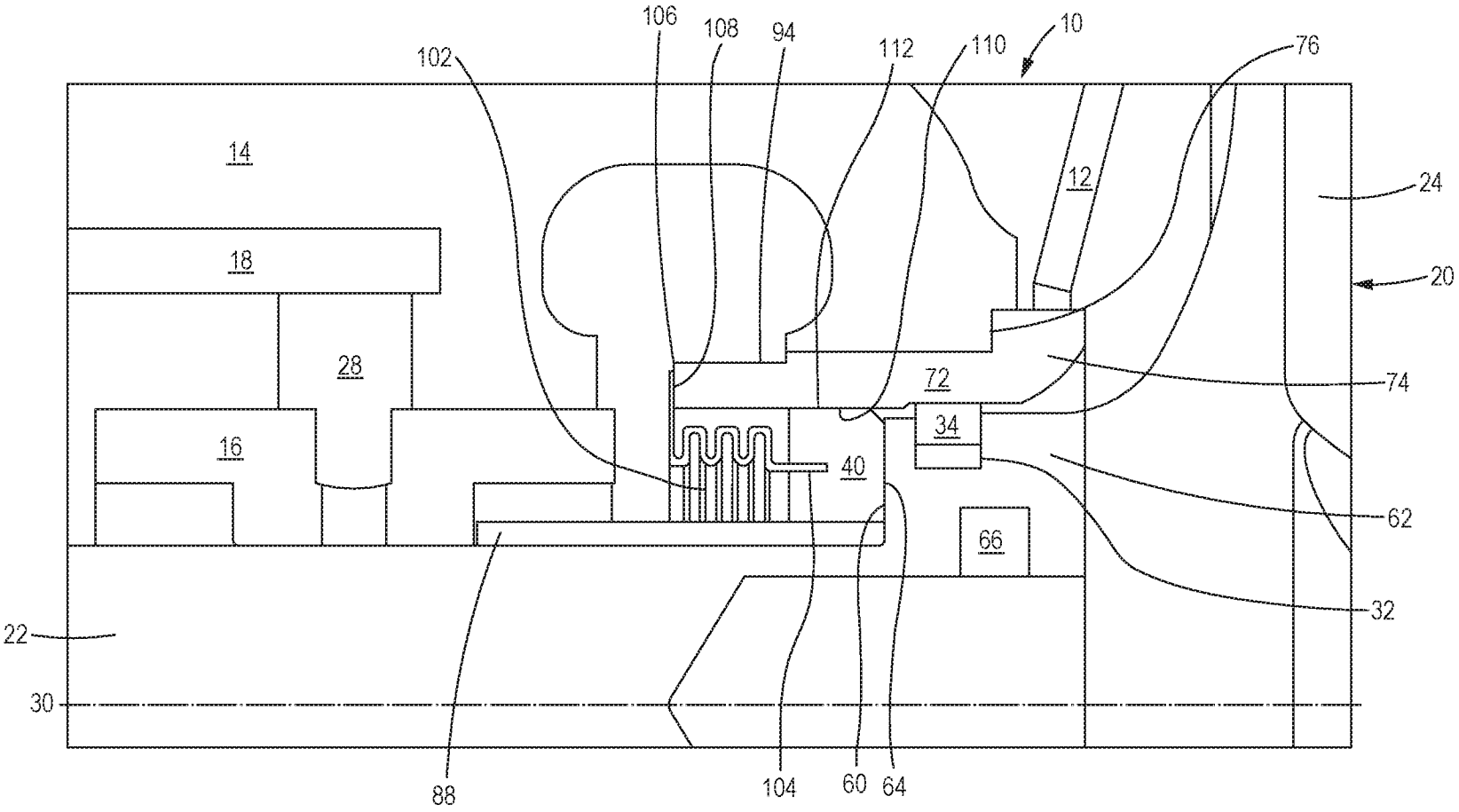
FIG. 8 is a cross-sectional view of a face seal of a turbomachine, employing a bellows construction in accordance with an embodiment of the present disclosure.

FIG. 8 illustrates another embodiment of the present face seal 10, replacing the seal element 44 and biasing element 42 shown in FIGS. 4-7 with a bellows 102, which may perform the biasing and sealing functions of those components. As in the other embodiments, a piston ring 34 may or may not be used in addition to the face seal 10 to further reduce blowby.

In this embodiment, as shown in the previous embodiments at FIGS. 4-7, the casing 72 includes the radially outwardly extending retaining flange 74 proximate the turbine wheel 24, which engages an exterior surface 76 of the bearing housing 14. The engagement of the retaining flange 74 with the exterior surface 76 of the bearing housing 14 both restricts axial movement of the casing 72 within the bearing housing, and creates a seal that prevents entry of gas and contaminants into the bearing housing. Unlike the previous embodiments, however, in this embodiment, the casing 72 does not include an oil flange 78. Instead, the casing 72 extends axially inward, away from the turbine wheel 24 and remains parallel to the axis of rotation 30.

The face seal 10 includes the spacer 88, which restricts axial movement of the journal bearing 16 within the bearing housing 14, and reduces heat transfer to the face seal from the shaft 22. The spacer 88 may be fixed to the radially outside surface of the shaft 22, and may be made of a metal with low thermal conductivity, to reduce heat transfer from the shaft to the seal ring 40, bellows 102, casing 72, and journal bearing 16. The spacer 88 may be fixed to the shaft 22 by an interference fit, to enable rotation with shaft; however, other methods of fixing the spacer to the shaft may be utilized, including, but not limited to, crimping or welding.

The bellows 102 may surround the shaft 22 and spacer 88, and a turbine side 104 may be affixed to the seal ring 40. Opposite the turbine side 104, the bellows 102 includes a radially outwardly extending seal flange 106, which may be affixed to an axially interior surface 108 of the casing 72. The seal flange 106 of the bellows 102 may be affixed to the surface 108 of the casing 72, for example, by resistance welding. Any other suitable means may be used, however, such as laser welding, or brazing. Fixing the seal flange 106 of the bellows 102 to the interior surface 108 of the casing 72 creates a seal that restricts entry of gasses and contaminants into the turbomachine that may enter through a gap between a radially exterior periphery 110 of the seal ring 40 and a radially interior periphery 112 of the casing. In this arrangement, the bellows 102 may replace the seal element 44 described in relation to the previous embodiments shown in FIGS. 4-6. The bellows 102 may likewise replace the biasing element 42 of the previous embodiments shown in FIGS. 4-6 by biasing the retaining flange 74 of the casing 72 against the exterior surface 76 of the bearing housing 14, both restricting axial movement of the casing within the bearing housing, and creating a seal that prevents entry of gas and contaminants into the bearing housing.

For all embodiments of the invention, seal element 44 may be an O-ring, a lip seal, quad ring, X-ring, tubular ring, packing, or any suitable seal member that seals against fluid leakage while allowing for axial motion of the seal ring 40 relative to the casing 72.

INDUSTRIAL APPLICATION

In general, the teachings of the present disclosure may find broad applicability in many industries including, but not limited to, automotive, marine, aerospace, renewable energy production, and transportation industries. More specifically, the teachings of the present disclosure may find applicability in any industry having vehicles or machines with engine systems that operate in high temperature applications (e.g. spark ignition engines, turbocharged gasoline engines, etc.).

Those skilled in the art will recognize that any of the features shown in the embodiments may be combined or eliminated as needed to create additional alternate embodiments to increase or decrease the cooling of sealing elements, and to control blowby, as needed, in a particular application.

What is claimed is:

1. A turbocharger face seal, comprising:

a turbine wheel;

a cylindrical shaft extending from the turbine wheel and defining an axis of rotation, the shaft having a radially outwardly extending shaft flange proximate the turbine wheel;

a compressor wheel connected to an end of the shaft opposite the turbine wheel;

a bearing housing;

a casing circumscribing the shaft and having a radially outwardly extending retaining flange to engage an outer edge of the bearing housing, the casing having a radially inwardly extending oil flange opposite the retaining flange;

a seal ring positioned radially between the casing and the shaft;

an oil gallery extending through the bearing housing and being adapted to have a supply of oil; and a pressurized oil jet extending from the oil gallery through an oil jet orifice toward the casing and directly impinging a surface of the casing.

2. The turbocharger face seal of claim 1, wherein the shaft includes a shaft weld pocket having an annular heat choke groove.

3. The turbocharger face seal of claim 1, wherein the seal ring is positioned axially between the radially outwardly extending shaft flange and the radially inwardly extending oil flange.

4. The turbocharger face seal of claim 3, wherein the seal ring includes an annular groove dimensioned to accommodate a seal element.

5. The turbocharger face seal of claim 4, wherein the impinged surface of the casing is proximate the seal element and concave to capture oil of the oil jet, the captured oil cooling the seal element.

6. The turbocharger face seal of claim 1, further including a biasing element positioned between the casing and the seal ring.

7. A turbocharger face seal, comprising:

a turbine wheel;

a cylindrical shaft extending from the turbine wheel and defining an axis of rotation, the shaft having a radially outwardly extending shaft flange proximate the turbine wheel;

a compressor wheel connected to an end of the shaft opposite the turbine wheel;

a bearing housing;

a casing circumscribing the shaft and having a radially outwardly extending retaining flange to engage an outer edge of the bearing housing, the casing having a radially inward extending oil flange opposite the retaining flange;

a seal ring positioned radially between the casing and the shaft;

an oil gallery extending through the bearing housing and being adapted to have a supply of oil;

an oil supply cavity fluidly connected to the oil gallery; and an axially oriented pressurized oil jet extending from the oil cavity through an axially oriented oil jet orifice toward the oil flange and directly impinging a surface of the oil flange.

8. The turbocharger face seal of claim 7, wherein the seal ring is positioned axially between the radially outwardly extending shaft flange and the radially inwardly extending oil flange, and includes an annular groove dimensioned to accommodate a seal element.

9. The turbocharger face seal of claim 8, wherein the impinged surface of the oil flange is grooved to increase heat transfer away from the seal element.

10. The turbocharger face seal of claim 7, further including a biasing element positioned between the casing and the seal ring.

11. The turbocharger face seal of claim 7, wherein the bearing housing includes a journal bearing having a second oil jet orifice.

12. The turbocharger face seal of claim 11, further including a spacer with a radially inner surface and an opposite outer surface, wherein the inner surface of the spacer is fixed to a radially exterior surface of the shaft, the spacer being positioned radially between the shaft and at least one of the seal ring, the casing, and at least a portion of the journal bearing.

13. The turbocharger face seal of claim 12, wherein the spacer further includes a rib protruding radially outward from the outer surface of the spacer.

14. The turbocharger face seal of claim 13, further including a second pressurized oil jet extending from the oil cavity through the second oil jet orifice toward the spacer rib and impinging a surface of the spacer rib.

15. The turbocharger face seal of claim 7, wherein the shaft includes a shaft weld pocket having an annular heat choke groove.

16. A turbocharger face seal, comprising:

a turbine wheel;

a cylindrical shaft extending from the turbine wheel and defining an axis of rotation, the shaft having a radially outwardly extending shaft flange proximate the turbine wheel;

a compressor wheel connected to an end of the shaft opposite the turbine wheel;

a bearing housing;

a journal bearing having an axial oil jet orifice;

a casing circumscribing the shaft; the casing having a radially inwardly extending oil flange opposite a radially outwardly extending retaining flange, the radially outwardly extending retaining flange engaging an outer edge of the bearing housing, and the casing including a concave recess defining a heat transfer surface;

a balanced pressure seal ring positioned radially between the shaft and the casing;

an oil cavity fluidly connected to the journal bearing; and a pressurized oil jet extending from the journal bearing through an axial oil jet orifice toward the heat transfer surface and directly impinging the heat transfer surface.

17. The turbocharger face seal of claim 16, the heat transfer surface being grooved to augment heat transfer away from the seal element.

18. The turbocharger face seal of claim 16, wherein the shaft includes a shaft weld pocket having an annular heat choke groove.

* * * * *